US005892436A

United States Patent [19]

Blackburn et al.

[11] Patent Number: 5,892,436

[45] Date of Patent: Apr. 6, 1999

[54] ILLUMINATED SEAT BELT BUCKLE

[75] Inventors: Brian K. Blackburn, Rochester; Scott B. Gentry, Romeo; Barney J. Bauer, Fenton, all of Mich.

[73] Assignees: TRW Inc.; TRW Vehicle Safety, System Inc., both of Lyndhurst, Ohio

[21] Appl. No.: 747,165

[22] Filed: Nov. 8, 1996

[51] Int. Cl.[6] ..... B60Q 1/00

[52] U.S. Cl. ..... 340/457.1; 340/686; 340/815.42; 24/633; 24/639; 180/268; 180/270; 250/227.11; 280/801.1; 362/32; 362/61; 385/115; 385/901; 359/151; 359/173

[58] Field of Search ..... 340/467.1, 686, 340/815.42; 24/602, 633 R, 639 R, 640; 180/268 R, 269, 270 R; 250/227.11 R, 227.14, 227.22; 280/801.1 R, 805; 362/32 R, 75, 61 R, 83.3, 108, 251, 394; 385/115 R, 147, 901 R; 359/144, 151 R, 173 R, 188

[56] References Cited

U.S. PATENT DOCUMENTS

| | | | |
|---|---|---|---|
| 3,718,814 | 2/1973 | Van Slyke | 362/32 |
| 3,840,849 | 10/1974 | Lohr | 340/457.1 |
| 4,172,631 | 10/1979 | Yevick | 385/115 |
| 4,365,285 | 12/1982 | Brundidge | 362/32 |
| 4,845,596 | 7/1989 | Mouissie | 362/32 |
| 5,132,880 | 7/1992 | Kawamura | 362/32 |
| 5,136,480 | 8/1992 | Pristash et al. | 362/32 |
| 5,149,189 | 9/1992 | Kawamura | 362/32 |
| 5,176,439 | 1/1993 | Kawamura | 362/32 |
| 5,181,773 | 1/1993 | Colvin | 362/75 |
| 5,226,105 | 7/1993 | Myers | 362/31 |
| 5,307,245 | 4/1994 | Myers et al. | 362/32 |
| 5,312,569 | 5/1994 | Mezei | 364/1.24 |
| 5,312,570 | 5/1994 | Halter | 264/1.24 |
| 5,438,492 | 8/1995 | Collins et al. | 24/633 |

*Primary Examiner*—Daniel J. Wu
*Attorney, Agent, or Firm*—Tarolli, Sundheim, Covell, Tummino & Szabo

[57] ABSTRACT

A seat belt buckle (12) has a light-transmitting portion (26) which is visible to a vehicle occupant. The buckle (12) includes a housing (60) containing a latch mechanism (20) which releasably locks a seat belt tongue (16) in the housing (60). The housing (60) further contains a light source (70) and optical fibers (72) for conducting light from the source (70) to the light-transmitting portion (26) of the buckle (12).

13 Claims, 5 Drawing Sheets

ILLUMINATED SEAT BELT BUCKLE

FIELD OF THE INVENTION

The present invention relates to a seat belt buckle for use in a vehicle.

BACKGROUND OF THE INVENTION

A seat belt system for restraining a vehicle occupant typically includes seat belt webbing, a seat belt locking tongue on the webbing, and a seat belt buckle. The tongue on the webbing is inserted and locked in the buckle to secure the webbing about a vehicle occupant. Such a seat belt system may also include an illuminating structure for illuminating the buckle to help the vehicle occupant locate the buckle.

SUMMARY OF THE INVENTION

In accordance with the present invention, a seat belt buckle has a light-transmitting portion which is visible to a vehicle occupant. The buckle includes a housing containing a latch mechanism which releasably locks a seat belt tongue in the housing. The housing further contains a light source and optical fibers for conducting light from the source to the light-transmitting portion of the buckle.

In the preferred embodiments of the present invention, the light-transmitting portion of the buckle is shaped as a frame for a pushbutton at an end of the buckle. In one preferred embodiment, the optical fibers have terminal end surfaces abutting the light-transmitting portion of the buckle. In another preferred embodiment, the housing further contains an illuminating panel structure. The illuminating panel structure has a reflective surface oriented to reflect light from the optical fibers to the light-transmitting portion of the buckle.

BRIEF DESCRIPTION OF THE DRAWINGS

The foregoing and other features of the present invention will become apparent to one skilled in the art to which the present invention relates upon consideration of the following description of the invention with reference to the accompanying drawings, wherein.

DESCRIPTION OF PREFERRED EMBODIMENTS

Figures 1, 5:
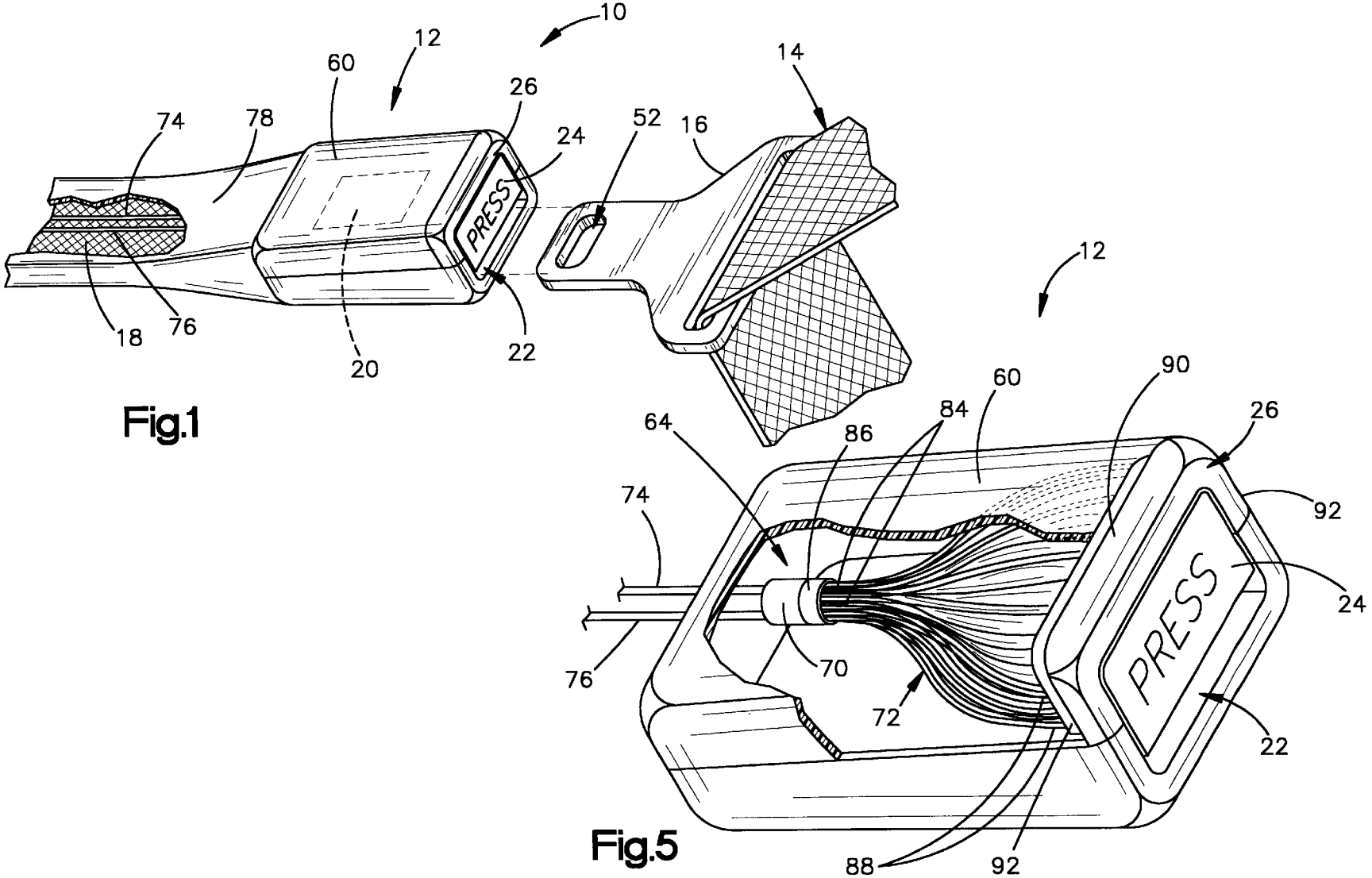
FIG. 1 is a perspective view of a vehicle occupant restraint apparatus including a seat belt buckle comprising a first embodiment of the present invention.
FIG. 5 is a partly sectional perspective view of parts of the buckle of FIG. 1.

A vehicle occupant restraint apparatus 10 comprising a first embodiment of the present invention is shown partially in FIG. 1. The apparatus 10 includes a seat belt buckle 12, seat belt webbing 14, and a seat belt locking tongue 16 on the webbing 14. The buckle 12 is anchored in a vehicle in a known manner, such as by an anchor strap 18. A latch mechanism 20 (shown schematically) locks the tongue 16 in the buckle 12 when the tongue 16 is inserted through an opening 22 at the upper end of the buckle 12. The tongue 16 is subsequently released from the buckle 12 upon depression of a pushbutton 24 adjacent to the opening 22. In accordance with the present invention, the buckle 12 has a light-transmitting portion 26 for helping a vehicle occupant to locate the opening 22 and the pushbutton 24.

The latch mechanism 20 may comprise any structure capable of cooperating with the tongue 16 and the pushbutton 24 for locking of the tongue 16 in the buckle 12. As shown by way of example in FIGS. 2–4, the latch mechanism 20 in the first embodiment of the present invention includes a guide track 32, an ejector 34, and a latch member 36.

Figure 2:
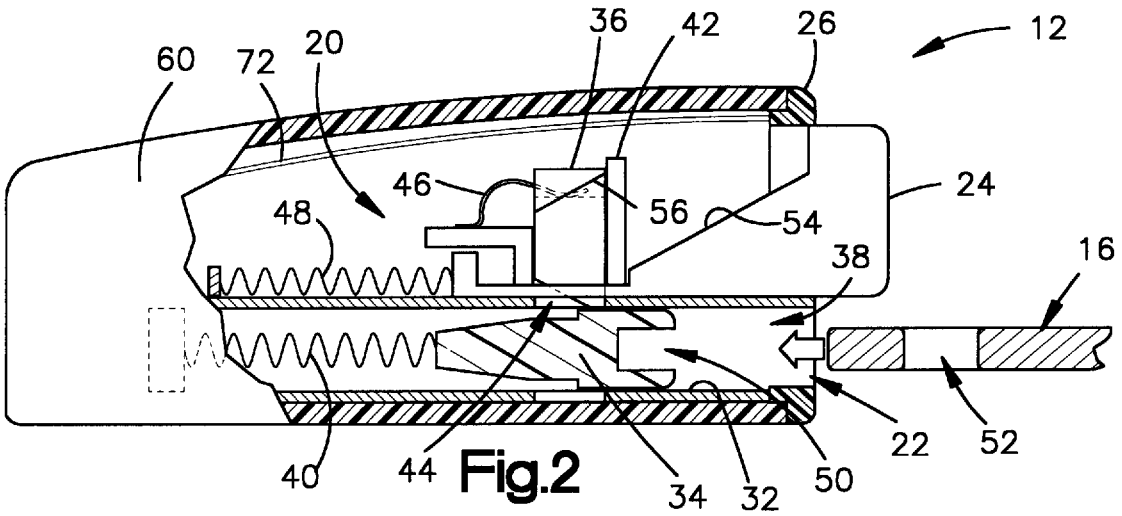
FIG. 2 is a side view, partly in section, of the buckle and another part of the apparatus of FIG. 1.
Figure 3:
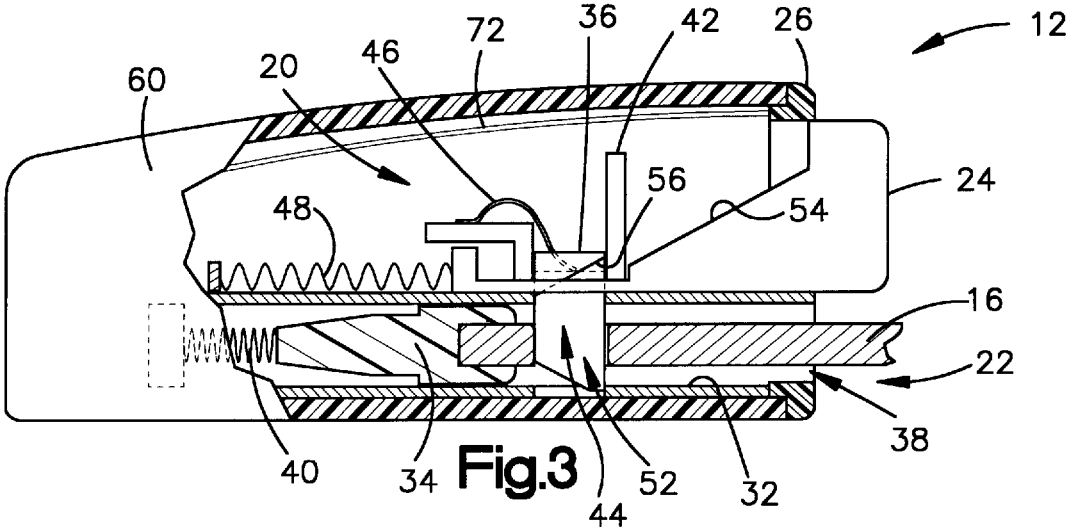
FIGS. 3 and 4 are views similar to FIG. 2 showing parts in different positions.
Figure 4:
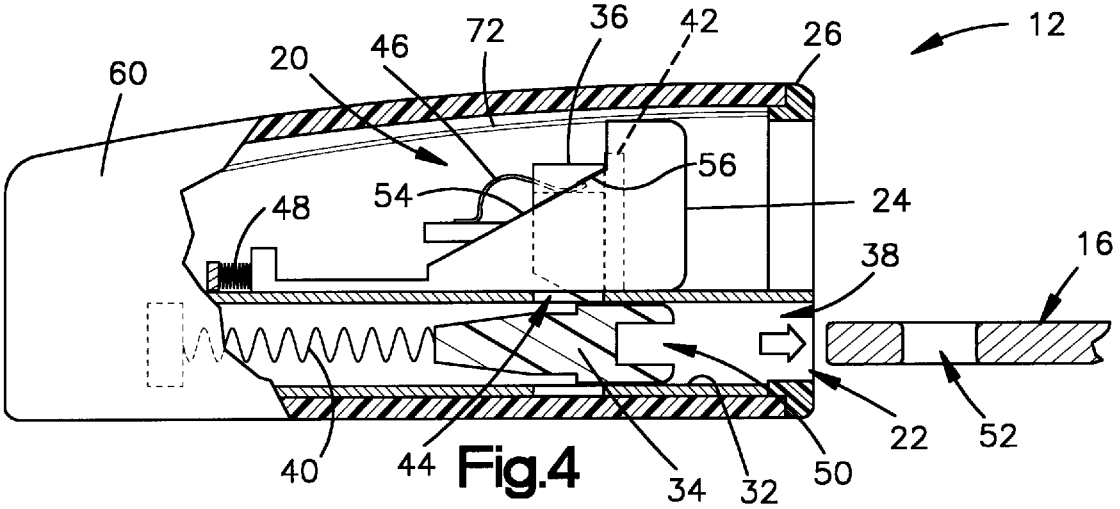

The guide track 32 defines a passage 38 extending inward from the opening 22. The ejector 34 is located in the passage 38, and is slidable along the passage 38 between the forward and rearward positions in which it is shown in FIGS. 2 and 3, respectively. An ejector spring 40 exerts a bias urging the ejector 34 toward the forward position.

A support structure 42 supports the latch member 36 for movement into and across the passage 38 through an opening 44 in the guide track 32. The latch member 36 is thus movable from a non-locking position above the passage 38 in the guide track 32 (FIG. 2) to a locking position extending across the passage 38 in the guide track 32 (FIG. 3). A latch spring 46 exerts a bias urging the latch member 36 toward the locking position. The pushbutton 24 is slidable along the top of the guide track 32 from a rest position (FIGS. 2 and 3) to a release position (FIG. 4) against the bias of a pushbutton spring 48.

The ejector 34 and the latch member 36 are located in the positions of FIG. 2 before the tongue 16 is locked in the buckle 12. The latch member 36 is then supported in the non-locking position by the ejector 34 which, in turn, is held in the forward position by the ejector spring 40. When the tongue 16 is moved into the passage 38, as indicated by the arrow shown in FIG. 2, it is moved into engagement with the ejector 34 in a notch 50 formed at the forward end of the ejector 34. The tongue 16 is then moved inward against the ejector 34 so as to slide the ejector 34 to the rearward position of FIG. 3 against the bias of the ejector spring 40. As the tongue 16 approaches the position of FIG. 3, an aperture 52 in the tongue 16 moves beneath the latch member 36. The latch spring 46 then moves the latch member 36 across the passage 38 through the aperture 52 in the tongue 16. As a result, the latch member 36 extends through the aperture 52 in the tongue 16 to block removal of the tongue 16 from the buckle 12 when the latch member 36 is in the locking position.

When the pushbutton 24 is moved from the rest position (FIG. 3) to the release position (FIG. 4), an inclined ramp portion 54 of the pushbutton 24 slides beneath an inclined arm portion 56 of the latch member 36. The pushbutton 24 lifts the latch member 36 from the locking position to the non-locking position against the bias of the latch spring 46. The ejector spring 40 then slides the ejector 34 back to the forward position to eject the tongue 16 from the buckle 12.

As shown in FIG. 1, the light-transmitting portion 26 of the buckle 12 is an upper end portion of a housing 60 which contains the latch mechanism 20. The upper end portion 26 of the housing 60 may be formed of any suitable light-transmitting material, such as plastic or glass, and may be either clear or tinted. As best shown in FIG. 5, the housing 60 further contains an illuminating assembly 64. (The latch mechanism 20 is omitted from FIG. 5 for clarity of illustration.) The illuminating assembly 64 includes a source 70 of light and a plurality of optical fibers 72 for conducting light from the source 70 to the upper end portion 26 of the housing 60.

The source 70 of light is a light emitting diode (LED), but any other suitable source of light, such as an incandescent bulb, can be used in accordance with the present invention. Electrical lead wires 74 and 76 extend outward from the lower end of the housing 60 for connection of the LED 70 in an electrical circuit. A decorative cover 78 (FIG. 1) on the anchor strap 18 conceals the lead wires 74 and 76.

Figure 6:
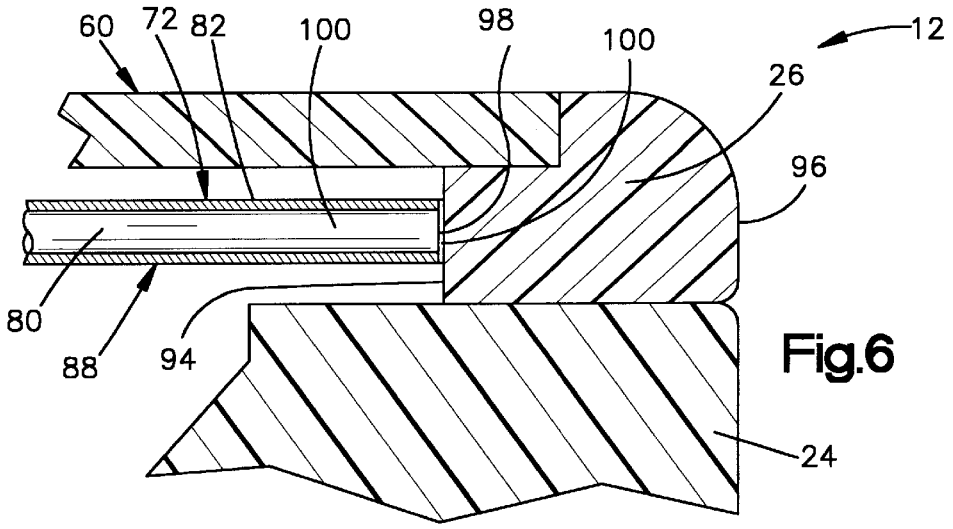
FIG. 6 is an enlarged sectional view of parts shown in FIG. 5.

As shown in FIG. 6 with reference to one of the optical fibers 72, each optical fiber 72 in the first embodiment of the present invention is a step index optical fiber having a glass core 80 with a glass cladding 82. As known in the art, each core 80 has a first refractive index. Each cladding 82 has a second, lower refractive index.

The optical fibers 72 have lower end sections 84 (FIG. 5) bundled in a ferrule 86 on the LED 70. The optical fibers 72 further have upper end sections 88 in an array extending along the length of the upper end portion 26 of the housing 60. Specifically, the upper end portion 26 of the housing 60 is a generally U-shaped frame with a base 90 and a pair of parallel arms 92 which together extend along three sides of the pushbutton 24. The upper end sections 88 of the optical fibers 72 are arranged side-by-side in an array extending along the lengths of the base 90 and the arms 92.

As shown in greater detail in the sectional view of FIG. 6, the upper end portion 26 of the housing 60 has a planar inner edge surface 94 and a rounded outer edge surface 96. Each optical fiber 72 has a terminal end surface 98 abutting the inner edge surface 94. An adhesive bond 100 fixes the optical fibers 72 to the upper end portion 26 of the housing 60 at the abutting surfaces 94 and 98. The bond 100 may be formed of any suitable light-transmitting adhesive material known in the art. The terminal end surfaces 98 of the optical fibers 72 thus face outward through the upper end portion 26 of the housing 60 toward the outer edge surface 96.

When the LED 70 is energized, the optical fibers 72 conduct light from the LED 70 to the upper end portion 26 of the housing 60. As the light emerges from the terminal end surfaces 98 of the optical fibers 72, it propagates throughout the upper end portion 26 to illuminate the housing 60 at the outer edge surface 96. The pushbutton 24 is thus framed on three sides by an illuminated surface 96 so that a vehicle occupant can easily locate the pushbutton 24 and the adjacent opening 22.

Figure 7:
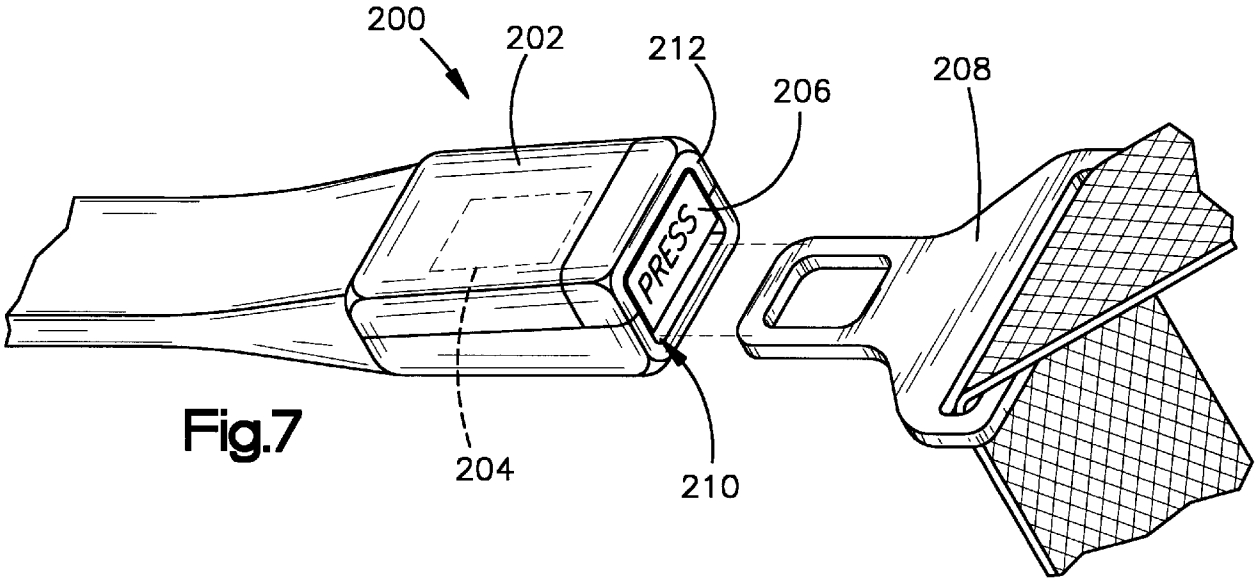
FIG. 7 is a perspective view of a vehicle occupant restraint apparatus including a seat belt buckle comprising a second embodiment of the present invention.

A buckle 200 comprising a second embodiment of the present invention is shown in FIG. 7. Like the buckle 12 described above, the buckle 200 has a housing 202 containing a latch mechanism 204 (shown schematically). The latch mechanism 204 is preferably the same as the latch mechanism 20 described above, but can have any alternative structure capable of cooperating with a pushbutton 206 to releasably lock a seat belt tongue 208 in the buckle 200 upon insertion of the tongue 208 through an opening 210 in the buckle 200. Like the housing 60 described above, the housing 202 has a light-transmitting upper end portion 212 with a generally U-shaped configuration extending along three sides of the pushbutton 206.

Figure 8:
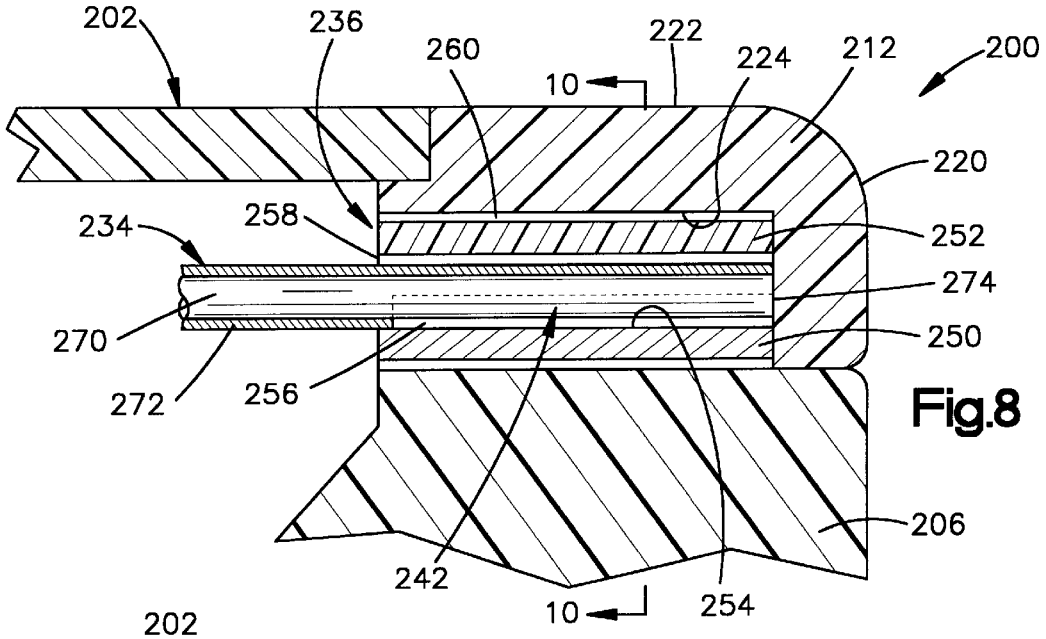
FIG. 8 is an enlarged sectional view of parts of the buckle of FIG. 7.

As best shown by comparison of FIG. 8 with FIG. 6, the upper end portion 212 of the housing 202 is substantially larger than the upper end portion 26 of the housing 60 described above. Specifically, the upper end portion 212 has a somewhat rounded outer edge surface 220 like the outer edge surface 96 (FIG. 6), but further has a planar outer side surface 222 extending rearwardly, i.e. to the left as viewed in FIG. 8, from the outer edge surface 220. An oppositely facing, planar inner side surface 224 is parallel to the outer side surface 222.

Figure 9:
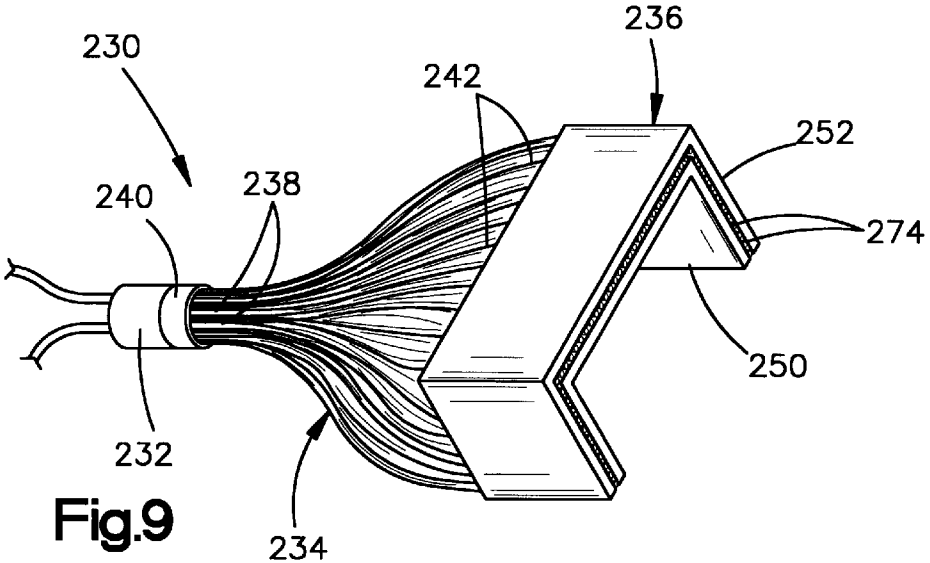
FIG. 9 is a perspective view of parts of the buckle of FIG. 7.

The housing 202 further contains an illuminating assembly 230 which, as shown separately in FIG. 9, includes an LED 232, a plurality of optical fibers 234, and an illuminating panel structure 236. Lower end sections 238 of the optical fibers 234 are bundled in a ferrule 240 on the LED 232. Upper end sections 242 of the optical fibers 234 extend into the illuminating panel structure 236.

As shown in FIG. 9, the illuminating panel structure 236 includes a pair of panels 250 and 252 with an elongated, generally U-shaped configuration corresponding to the shape of the upper end portion 212 (FIG. 7) of the housing 202. The first panel 250 has a reflective surface 254 (FIG. 8) facing toward the second panel 252. The second panel 252 is formed of light-transmitting material which is preferably transparent and clear.

The upper end sections 242 of the optical fibers 234 are received between the first and second panels 250 and 252, and are arranged side-by-side in an array extending along the length of the illuminating panel structure 236. First and second layers 256 and 258 of light-transmitting adhesive material fix the upper end sections 242 to the first and second panels 250 and 252, respectively. A third layer 260 of light-transmitting adhesive material fixes the second panel 252 to the upper end portion 212 of the housing 202 at the inner side surface 224.

Figure 10:
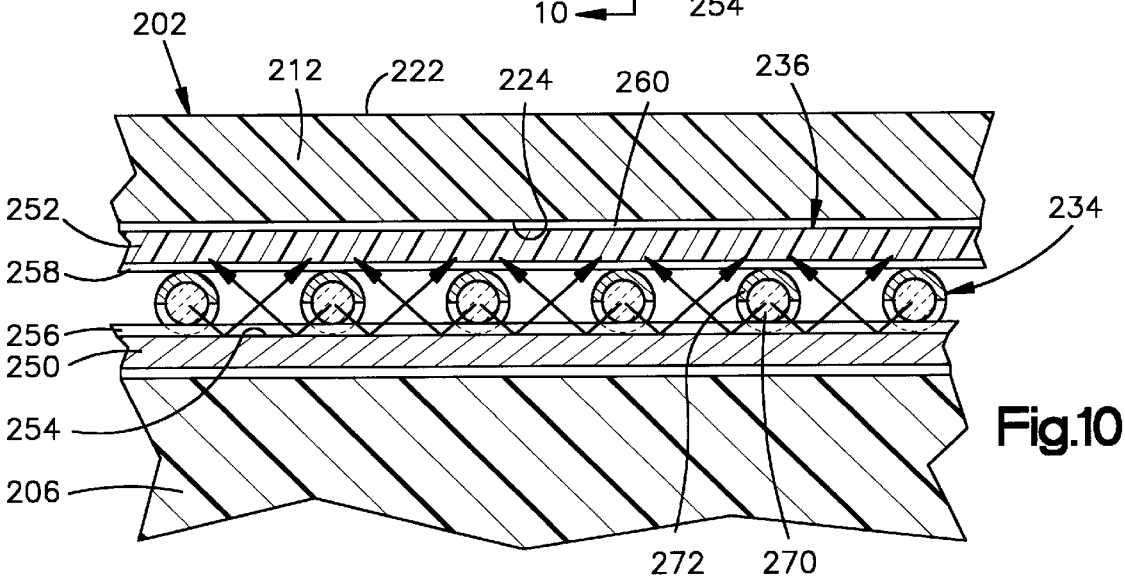
FIG. 10 is a view taken on line 10—10 of FIG. 8.

As shown in FIGS. 8 and 10, the optical fibers 234 in the second embodiment of the present invention are step index optical fibers having glass cores 270 and glass claddings 272. Each core 270 has a terminal end surface 274. Each cladding 272 is partially removed along the length of the upper end section 242 of the respective optical fiber 234. As a result, some of the light that is transmitted along the cores 270 reaches the terminal end surfaces 274, but some of the light is permitted to escape laterally from the cores 270 along the lengths of the upper end sections 242.

The light that reaches the terminal end surfaces 274 of the optical fibers 234 is transmitted directly into and through the upper end portion 212 of the housing 202 to illuminate the outer edge surface 220. The light that emerges laterally from the cores 272 is directed toward the reflective surface 254 of the first panel 250, and is reflected toward the second panel 252, as indicated by the arrows shown in FIG. 10. The reflected light propagates throughout the second panel 252. The reflected light is thus diffused throughout the entire area of the adjoining inner side surface 224 before it enters the upper end portion 212 of the housing 202 at the inner side surface 224. As a result, the reflected light illuminates the upper end portion 212 of the housing 202 throughout the entire area of the outer side surface 222.

The illuminating panel structure 236 is described above as an example of an illuminating panel structure that can be used in accordance with the present invention. A seat belt buckle constructed in accordance with the present invention could alternatively contain any other suitable illuminating panel structure that is capable of reflecting and diffusing light throughout a light-transmitting portion of the buckle. For example, known illuminating panel structures that could be adapted for use in accordance with the present invention are disclosed in U.S. Pat. Nos. 5,136,480; 5,226,105; 5,307,245; 5,312,569 and 5,312,570.

Figure 11:
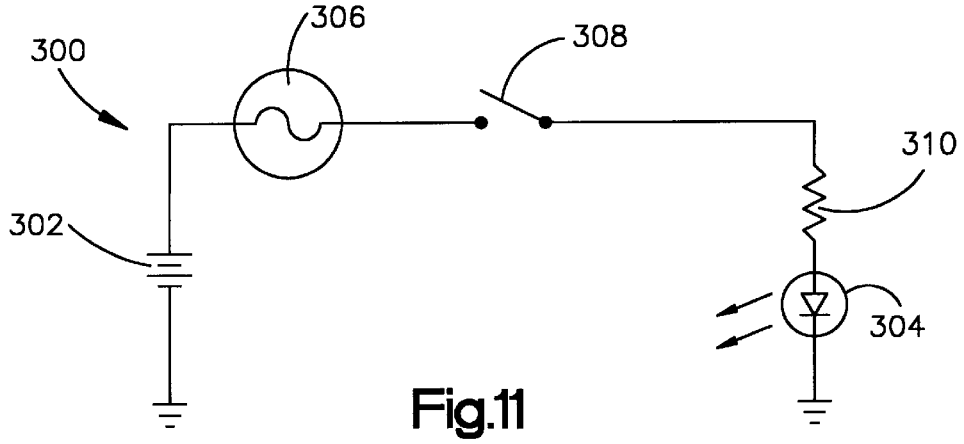
FIGS. 11–13 are schematic views of electrical circuits that can be used in accordance with the present invention.

FIG. 11 shows an electrical circuit 300 that can be used in accordance with the present invention. As shown schematically in FIG. 11, the circuit 300 includes a power source 302 and an LED 304. The power source 302 is preferably the vehicle battery. The LED 304 is connected with the power source 302 through a fuse 306, a normally open switch 308, and a resistor 310.

The LED 304 is energized when the switch 308 is closed. The switch 308 could comprise a vehicle ignition starter switch or a vehicle headlight switch, as known in the art. The switch 308 could alternatively comprise a door switch that opens and closes with the vehicle door.

Figure 12:
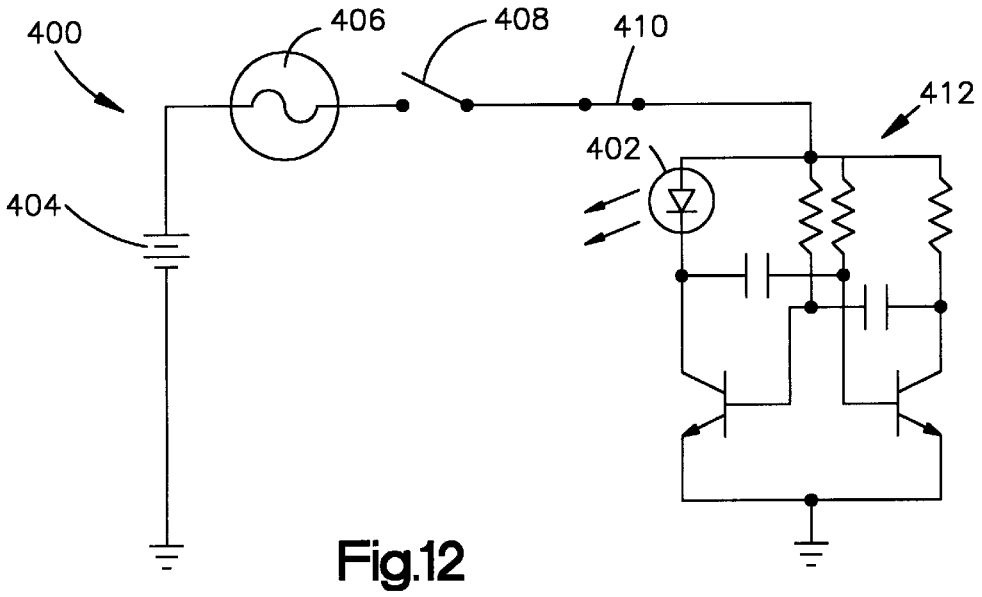

FIG. 12 shows an alternative electrical circuit 400 that can be used in accordance with the present invention. In the circuit 400, an LED 402 is connected with a power source 404 through a fuse 406, a pair of switches 408 and 410, and an astable oscillating circuit 412. The oscillating circuit 412 operates in a known manner to energize the LED 402 with a fixed duty cycle so as to cause the LED 402 to flash.

The first switch 408 is preferably the same as the switch 308 described above with reference to FIG. 11. The second switch 410 comprises a seat belt buckle switch. The buckle switch 410 opens in a known manner when a seat belt locking tongue is locked in a corresponding seat belt buckle. Accordingly, the LED 402 is turned on, and begins to flash, when the vehicle is started or when the headlights are turned on. The LED 402 is subsequently turned off when the tongue is locked in the buckle.

Figure 13:
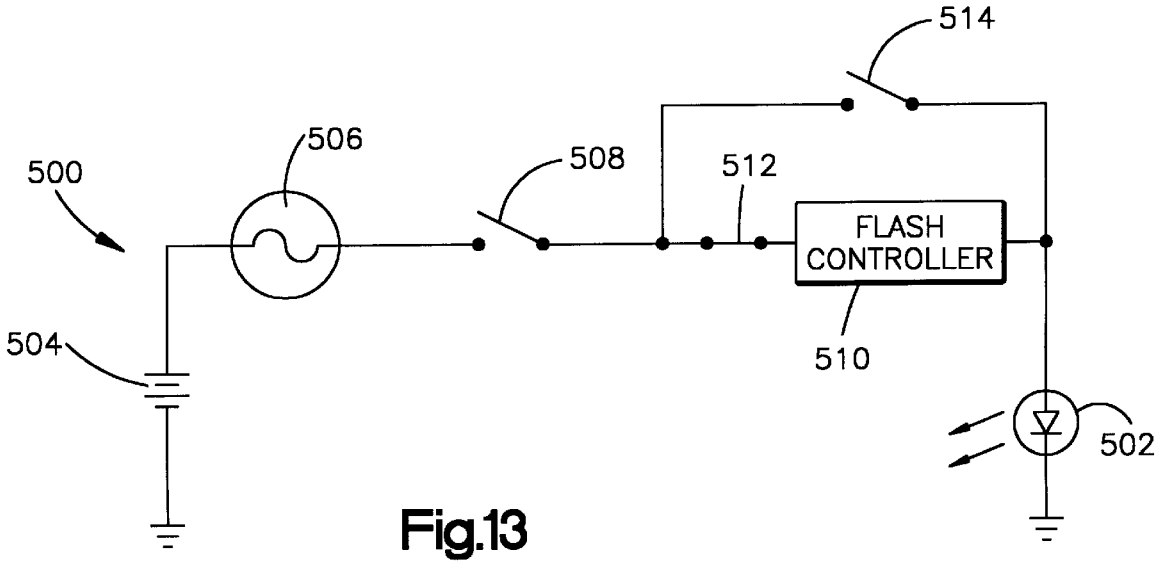

FIG. 13 shows another alternative electrical circuit 500 that can be used in accordance with the present invention. The circuit 500 includes an LED 502, a power source 504, a fuse 506, and a normally open switch 508. Those parts 502–508 of the circuit 500 are substantially the same as the corresponding parts 402–408 of the circuit 400 described above. The circuit 500 further includes a flash controller 510 and a pair of seat belt buckle switches 512 and 514. When a seat belt locking tongue is locked in a corresponding seat belt buckle, the first buckle switch 512 opens and the second buckle switch 514 simultaneously closes. The flash controller 510 may comprise any suitable apparatus that functions to cause the LED 502 to flash when the first buckle switch 512 is closed. Accordingly, the LED 502 begins to flash when the vehicle is started or when the headlights are turned on. The LED 502 is subsequently turned continuously on by operation of the buckle switches 512 and 514 when the tongue is locked in the buckle.

From the above description of the invention, those skilled in the art will perceive improvements, changes and modifications. For example, the preferred embodiments of the invention comprise end release buckles 12 and 200 with light-transmitting portions 26 and 212 that are shaped as frames for the pushbuttons 24 and 206 at the ends of the buckles 12 and 200. Alternative embodiments of the invention could comprise either end release or top (side) release buckles. The light-transmitting portions of the buckles could have configurations and/or locations that are either the same or different from those described above. Such improvements, changes and modifications within the skill of the art are intended to be covered by the appended claims.

Having described the invention, the following is claimed:

1. Apparatus comprising:

a seat belt buckle having a light-transmitting portion which is visible to a vehicle occupant;

said buckle including a housing containing a latch mechanism which releasably locks a seat belt tongue in said housing;

said housing further containing optical fibers and an illuminating panel structure, said illuminating panel structure comprising a panel with a reflective surface oriented to reflect light from said optical fibers to said light-transmitting portion of said buckle.

2. Apparatus as defined in claim 1 wherein said optical fibers have end sections oriented to direct light onto said reflective surface along the lengths of said end sections.

3. Apparatus as defined in claim 2 wherein said illuminating panel structure further comprises a light-transmitting panel overlying said end sections of said optical fibers.

4. Apparatus as defined in claim 3 wherein said light-transmitting panel is fixed to said light-transmitting portion of said buckle by a layer of light-transmitting adhesive material.

5. Apparatus as defined in claim 1 wherein said housing further contains a source of light, said optical fibers extending from said source of light to said illuminating panel structure.

6. Apparatus as defined in claim 5 wherein said light-transmitting portion of said buckle is a portion of said housing.

7. Apparatus as defined in claim 1 wherein said light-transmitting portion of said buckle has a generally U-shaped configuration extending along three sides of a pushbutton at an end of said buckle, said illuminating panel structure having a generally U-shaped configuration corresponding to said configuration of said light-transmitting portion of said buckle.

8. Apparatus as defined in claim 1 further comprising first electrical circuit means for causing said light source to flash in response to a predetermined vehicle condition, and second electrical circuit means for causing said light source to stop flashing in response to locking of said tongue in said housing.

9. Apparatus as defined in claim 8 wherein said second electrical circuit means turns said light source off in response to locking of said tongue in said housing.

10. Apparatus as defined in claim 8 wherein said second electrical circuit means turns said light source continuously on in response to locking of said tongue in said housing.

11. Apparatus comprising:

a seat belt buckle having a light-transmitting portion which is visible to a vehicle occupant;

said buckle including a housing containing a latch mechanism which releasably locks a seat belt tongue in said housing;

said housing further containing a light source and optical fibers which conduct light from said source to said light-transmitting portion of said buckle;

said buckle further including a pushbutton which actuates said latch mechanism, said light-transmitting portion of said buckle having frame portions extending alongside corresponding sides of said pushbutton, said optical fibers being arranged side-by-side in an array extending along said frame portions;

said housing further containing an illuminating panel structure, said illuminating panel structure comprising a panel with a reflective surface oriented to reflect light from said optical fibers to said light-transmitting portion of said buckle.

12. Apparatus as defined in claim 11 wherein said optical fibers have end sections oriented to direct light onto said reflective surface along the lengths of said end sections.

13. Apparatus comprising:

a seat belt buckle containing a latch mechanism which releasably locks a seat belt tongue in said buckle, said buckle having a light-transmitting portion which is visible to a vehicle occupant;

an illuminating assembly including a source of light which illuminates said light-transmitting portion of said buckle from within said buckle;

first electrical circuit means for causing said source of light to flash in response to a predetermined vehicle condition; and second electrical circuit means for causing said source of light to stop flashing in response to locking of said tongue in said buckle;

said buckle including a housing containing said latch mechanism, said housing further containing said source of light, optical fibers, and an illuminating panel structure, said illuminating panel structure comprising a panel with a reflective surface oriented to reflect said light from said optical fibers to said light-transmitting portion of said buckle.

* * * * *